US010781011B2

(12) United States Patent
Rose

(10) Patent No.: US 10,781,011 B2
(45) Date of Patent: Sep. 22, 2020

(54) TEAR-AWAY PACKAGE AND SHIPPING TRAY CONVERTED THEREFROM

(71) Applicant: Menasha Corporation, Neenah, WI (US)

(72) Inventor: Santiago O. Rose, Westville, NJ (US)

(73) Assignee: Menasha Corporation, Neenah, WI (US)

( * ) Notice: Subject to any disclaimer, the term of this patent is extended or adjusted under 35 U.S.C. 154(b) by 29 days.

(21) Appl. No.: 16/011,102

(22) Filed: Jun. 18, 2018

(65) Prior Publication Data

US 2018/0370677 A1 Dec. 27, 2018

Related U.S. Application Data

(60) Provisional application No. 62/524,081, filed on Jun. 23, 2017, provisional application No. 62/546,933, filed on Aug. 17, 2017.

(51) Int. Cl.

| | |
|---|---|
| ***B65D 5/50*** | (2006.01) |
| ***B65D 5/54*** | (2006.01) |
| ***B65D 5/52*** | (2006.01) |
| *A47F 3/14* | (2006.01) |

(52) U.S. Cl.

CPC ..... *B65D 5/5023* (2013.01); *B65D 5/52* (2013.01); *B65D 5/5445* (2013.01); *A47F 3/14* (2013.01)

(58) Field of Classification Search

USPC ..... 206/745, 746, 736, 738, 774

See application file for complete search history.

(56) References Cited

U.S. PATENT DOCUMENTS

| | | | | | |
|---|---|---|---|---|---|
| 776,042 | A | * | 11/1904 | Acheson | B65D 5/52 206/745 |
| 1,896,721 | A | * | 2/1933 | Richards | B65D 5/52 206/765 |
| 1,901,483 | A | * | 3/1933 | Ware, Jr. | B65D 5/2038 206/745 |
| 1,988,280 | A | | 1/1935 | Levkoff | |
| 2,119,382 | A | * | 5/1938 | Cooper | B65D 85/542 206/745 |
| 2,259,041 | A | * | 10/1941 | Larkin | B65D 5/52 206/766 |
| 2,706,037 | A | | 4/1955 | Feigelman | |
| 2,723,026 | A | * | 11/1955 | Paige | B65D 5/5286 206/746 |
| 4,138,012 | A | | 2/1979 | Dutcher | |
| 4,488,652 | A | | 12/1984 | Hinton et al. | |
| 4,899,929 | A | | 2/1990 | Grollman | |
| 5,084,690 | A | | 1/1992 | Leupold | |
| 5,167,324 | A | | 12/1992 | Miller | |

(Continued)

*Primary Examiner* — Jacob K Ackun

(74) *Attorney, Agent, or Firm* — Greensfelder, Hemker & Gale, P.C.; Joseph A. Fuchs

(57) ABSTRACT

A tear-away package is disclosed having a front panel and a back panel; a right-side panel and an opposed left-side panel connected to opposed ends of the front panel and the back panel to define a polygonal shaped sleeve; a top panel and an opposed bottom panel are attached to opposite ends of the polygonal shaped sleeve to form a sealed chamber; a first fold line extends diagonally across the right-side panel to define two subpanels that are mirror images of one another; and a second fold line extends diagonally across the left-side panel to define two subpanels that are mirror images of one another.

6 Claims, 5 Drawing Sheets

(56) References Cited

U.S. PATENT DOCUMENTS

| | | | | |
|---|---|---|---|---|
| 5,722,584 | A | 3/1998 | Fujiwara | |
| 5,826,728 | A | 10/1998 | Sheffer | |
| 6,382,433 | B1 | 5/2002 | Podergois | |
| 6,676,012 | B1 | 1/2004 | Southwell et al. | |
| 6,729,475 | B2 | 5/2004 | Yuhas et al. | |
| 7,083,048 | B2 | 8/2006 | Taylor et al. | |
| 7,273,149 | B2 | 9/2007 | Lutes et al. | |
| 7,886,465 | B2 | 2/2011 | Virvo | |
| 8,091,715 | B2 | 1/2012 | Roth | |
| 8,376,141 | B2 * | 2/2013 | Couture | B65D 5/5445 206/746 |
| 8,827,078 | B2 | 9/2014 | Doemel et al. | |
| 8,910,856 | B2 * | 12/2014 | Sumpmann | B65B 69/0033 206/746 |
| 9,090,037 | B2 | 7/2015 | Swenson | |
| 9,181,025 | B2 | 11/2015 | Graham et al. | |
| 9,227,751 | B2 | 1/2016 | Scrimger | |
| 9,242,758 | B2 | 1/2016 | Brundage et al. | |
| 9,290,288 | B1 | 3/2016 | Ikeno et al. | |
| 9,382,041 | B2 | 7/2016 | Couture | |
| 9,440,763 | B1 | 9/2016 | Einstein | |
| D783,395 | S | 4/2017 | Wang | |
| 9,783,334 | B2 | 10/2017 | McLeod et al. | |
| 9,919,829 | B2 | 3/2018 | Jolley | |
| 9,938,040 | B2 | 4/2018 | Buscema | |
| 9,994,356 | B2 | 6/2018 | Couture | |
| 10,144,549 | B2 | 12/2018 | Manella | |
| D842,695 | S | 3/2019 | Haen et al. | |
| D842,696 | S | 3/2019 | Haen et al. | |
| 10,232,999 | B2 | 3/2019 | Lingamfelter | |
| D846,384 | S | 4/2019 | Borkovetz et al. | |
| D846,385 | S | 4/2019 | Borkovetz et al. | |
| D846,386 | S | 4/2019 | Borkovetz et al. | |
| 10,273,043 | B2 | 4/2019 | Couture | |
| 2006/0006096 | A1 | 1/2006 | Funk | |
| 2006/0289614 | A1 * | 12/2006 | Posselt | B65D 5/029 229/116.1 |
| 2010/0108623 | A1 | 5/2010 | Virvo | |
| 2011/0259947 | A1 | 10/2011 | Brittain | |
| 2012/0234724 | A1 * | 9/2012 | James | B65D 5/5445 206/774 |
| 2013/0020230 | A1 | 1/2013 | Doemel et al. | |
| 2013/0092596 | A1 * | 4/2013 | Couture | B65D 5/5445 206/746 |
| 2015/0041364 | A1 | 2/2015 | Schultz et al. | |
| 2015/0191272 | A1 | 7/2015 | McLeod et al. | |
| 2016/0304237 | A1 | 10/2016 | Couture | |
| 2017/0267398 | A1 | 9/2017 | Couture | |
| 2017/0267399 | A1 | 9/2017 | Buscema | |
| 2017/0275046 | A1 | 9/2017 | Manella | |
| 2017/0305593 | A1 | 10/2017 | Couture | |
| 2018/0162575 | A1 | 6/2018 | Buscema et al. | |
| 2018/0222626 | A1 | 8/2018 | Pfeifer et al. | |
| 2019/0016501 | A1 | 1/2019 | Djokovic et al. | |
| 2019/0023449 | A1 | 1/2019 | Barton et al. | |
| 2019/0135482 | A1 | 5/2019 | Pratsch et al. | |
| 2019/0270544 | A1 * | 9/2019 | Couture | B65D 25/54 |

* cited by examiner

FIG. 3

| | |
|---|---|
| 302 | Form left side by folding the left side panels 15 90° from the front panels 11 |
| 304 | Form right side by folding the right side panels 17 90° from the front panels 11 |
| 306 | Form back 13 by folding toward the left side 15 90° from the right side panels |
| 308 | Fold tabs and glue or tape |
| 318, 320, 322, 324 | Fold the minor flaps |
| 310, 312, 314, 316 | Fold the major flaps over the minor flaps and secure with tape or adhesive |

FIG. 4

| | |
|---|---|
| 450 | Break frangible handle |
| 452 | Break frangible line and remove panels 18 and 30 |
| 454 | Break frangible line and remove panels 16, 26 and 28 |
| 456 | Break frangible line and remove panels 14 and 24 |
| 458 | Break frangible line and remove panels 12, 20 and 22 |

SHIPPER TRAY RETAIL ASSEMBLY
INSTRUCTIONS
MENASHA

FRONT
LEFT SIDE
1
FRONT OF TRAY SHOWN ABOVE.

HAND SLOT
BACK
NEAR SIDE
2
INSERT FINGERS INTO REAR SLOT.

3
TEAR AWAY TOP PANEL OF SHIPPER TRAY.

4
FOLD FRONT PANEL AS SHOWN AND INSERT TABS TO SECURE.

5
FOLD SIDE PANELS AS SHOWN AND INSERT TABS TO SECURE.

6
DISPLAY IN DESIRED LOCATION.

TEAR-AWAY PACKAGE AND SHIPPING TRAY CONVERTED THEREFROM

CROSS-REFERENCE TO RELATED APPLICATIONS

The present invention claims the benefit of U.S. Provisional Patent Application Nos. 62/524,081, filed Jun. 23, 2017, and 62/546,933, filed Aug. 17, 2017, the contents of which are incorporated in their entirety herein by reference and made a part hereof.

FEDERALLY SPONSORED RESEARCH OR DEVELOPMENT

N/A

FIELD OF THE INVENTION

The present invention provides a blank for forming a tear-away package and more specifically a tear-away package that can be converted into a display tray by folding.

DESCRIPTION OF THE PRIOR ART

Point of purchase displays are widely used for sale of products in a retail environment and are often shipped in an assembled condition in a shipping container. The shipping container is disposed of or recycled by the end user, but the shipper has incurred the cost of assembling the display, the manufacturing of the shipping container, and the shipping and handling cost of both. It is desirable that a provider of such displays can ship them in an unassembled form for assembly by an end user to save the labor cost associated with assembly and to render the shipping container unnecessary.

SUMMARY OF THE INVENTION

The present invention provides an improved shipping container that can be converted into a display by tearing and folding at the destination location. To decrease the cost of shipping and to reduce the amount of scrap or waste material, the present invention provides a tear-away shipping container from which a display tray can be formed. Instead of including a display tray within a shipping container, the display tray is part of the shipping container and can be converted from the shipping container by tearing away portions of the container and folding the resulting blank into the desired display tray. Printed material is located on an inner surface of the container so that the printing is not damaged, scuffed or obscured during shipping. During the conversion, the blank can be folded outward to form an exterior of the display tray showing the printed subject matter. The present invention provides a blank for forming a tear-away package suitable for shipping and for converting into a display tray by a user of the tray. The blank can be a single continuous material or can be several pieces of material connected together.

The tear-away package has a front panel and a back panel, a right-side panel and an opposed left-side panel connected together to define a polygonal shaped sleeve. (As used herein, directional terms such as left/right, top/bottom are used with regard to the invention as shown in the figures or as normally positioned in use. They are not meant to limit the invention to a particular position.) A top panel and an opposed bottom panel are attached to opposite ends of the polygonal sleeve to form a sealed chamber. A first fold line extends diagonally across the right-side panel to define two subpanels that are nearly mirror images of one another, and a second fold line extends diagonally across the left-side panel to define two subpanels that are nearly mirror images of one another. The top panel and the bottom panel each has two minor flaps and two major flaps. The package has printed subject matter on an inner surface of one of the subpanels that appears on an outer panel of a tray when the tear-away package is converted into a tray. By placing the printed material on an inside surface it is protected from damage or scuffing during shipment.

The side panels have a first generally triangular side panel having a bottom leg, a vertical leg and a hypotenuse leg. The bottom panel extends between the first side panel and the second side panel and connects the bottom legs of each of the side panels. The back wall is generally polygonal-shaped and extends between the first side panel and the second side panel and connects the vertical legs of each of the side panels. The front panel extends between the first side panel and the second side panel and connects a front portion of each of the first side panel and the second side panel. A third generally triangular side panel depends from one of the legs of the first side panel and is secured to the first side panel and in registration therewith. A fourth generally triangular side panel depends from one of the legs of the second side panel and is secured to the second side panel in registration therewith. Preferably, the third and fourth panels extend from the hypotenuse leg respectively of the first and second side panels.

The present invention also provides a display tray converted from the tear-away package by tearing along a frangible tear line of the tear away package to form a tray blank. The tray blank has fold lines across which panels are folded to form a desired tray.

The present invention also provides a method for forming a display tray from the tear away package. The steps include: providing a tear-away package, tearing the tear-away package along a frangible line to remove the top wall, a portion of each of the back wall, the front wall, the right-side wall and the left-side wall to define a tray blank having a plurality of fold lines; folding the tray blank along a diagonally extending fold line on the right-side panel to place a first triangular shaped panel over a second triangular shaped panel and in registration and securing the first triangular shaped panel to the second triangular shaped panel. The method also includes the step of folding the tray blank along a diagonally extending fold line on the left-side panel to place a third triangular shaped panel over a fourth triangular shaped panel and in registration and securing the third triangular shaped panel to the fourth triangular shaped panel.

BRIEF DESCRIPTION OF THE DRAWINGS

To understand the present invention, it will now be described by way of example, with reference to the accompanying drawings and attachments in which:

FIG. 3 is a flow chart of the steps for forming a tear-away package from the blank shown in FIGS. 1, 2A and 2B.

FIG. 4 is a flow chart of the steps for forming a tray from the tear-away package.

DETAILED DESCRIPTION

Figure 1:
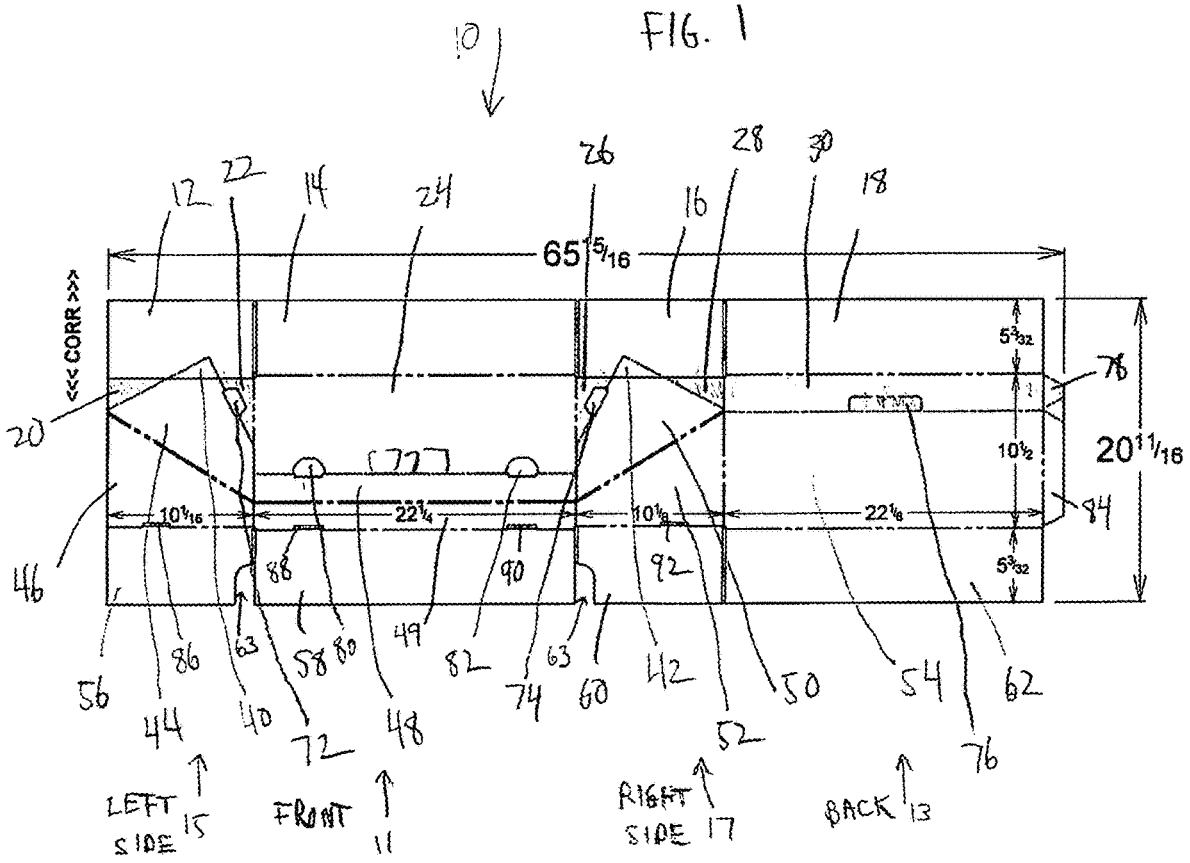
FIG. 1 is a top plan view of a blank for forming a tear-away package showing the panels.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2A:
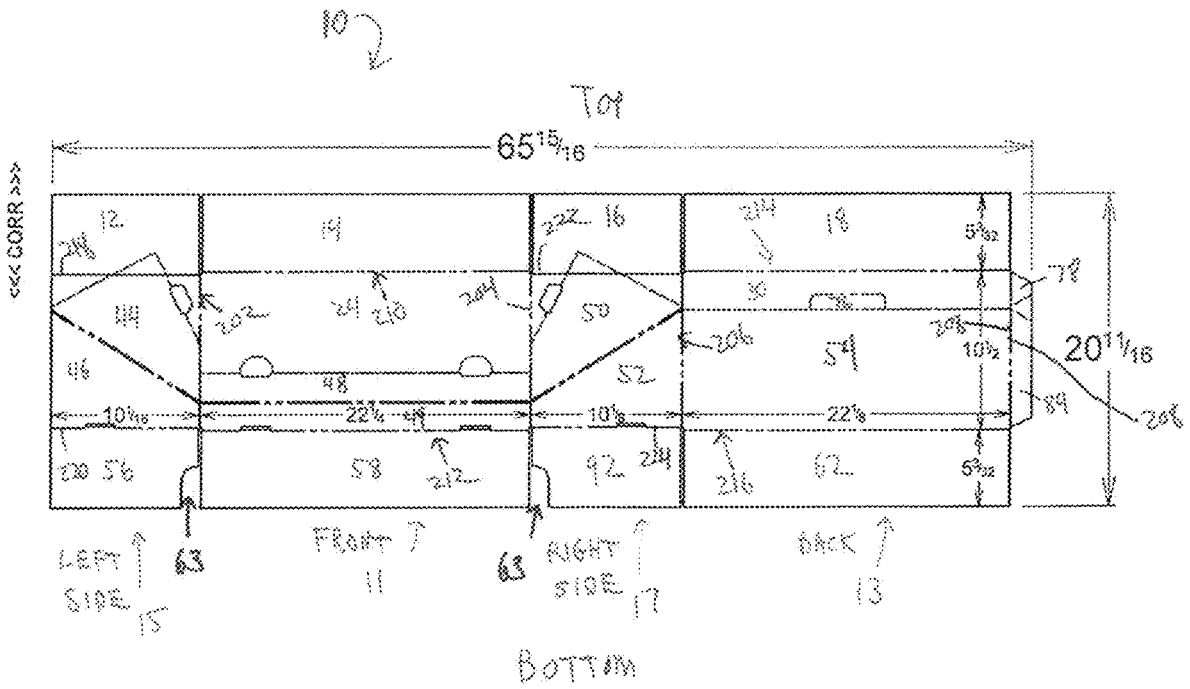
FIG. 2A is a top plan view of the blank of FIG. 1 showing fold lines for forming a tear-away package.
Figures 5, 6, 7, 8, 9, 10:
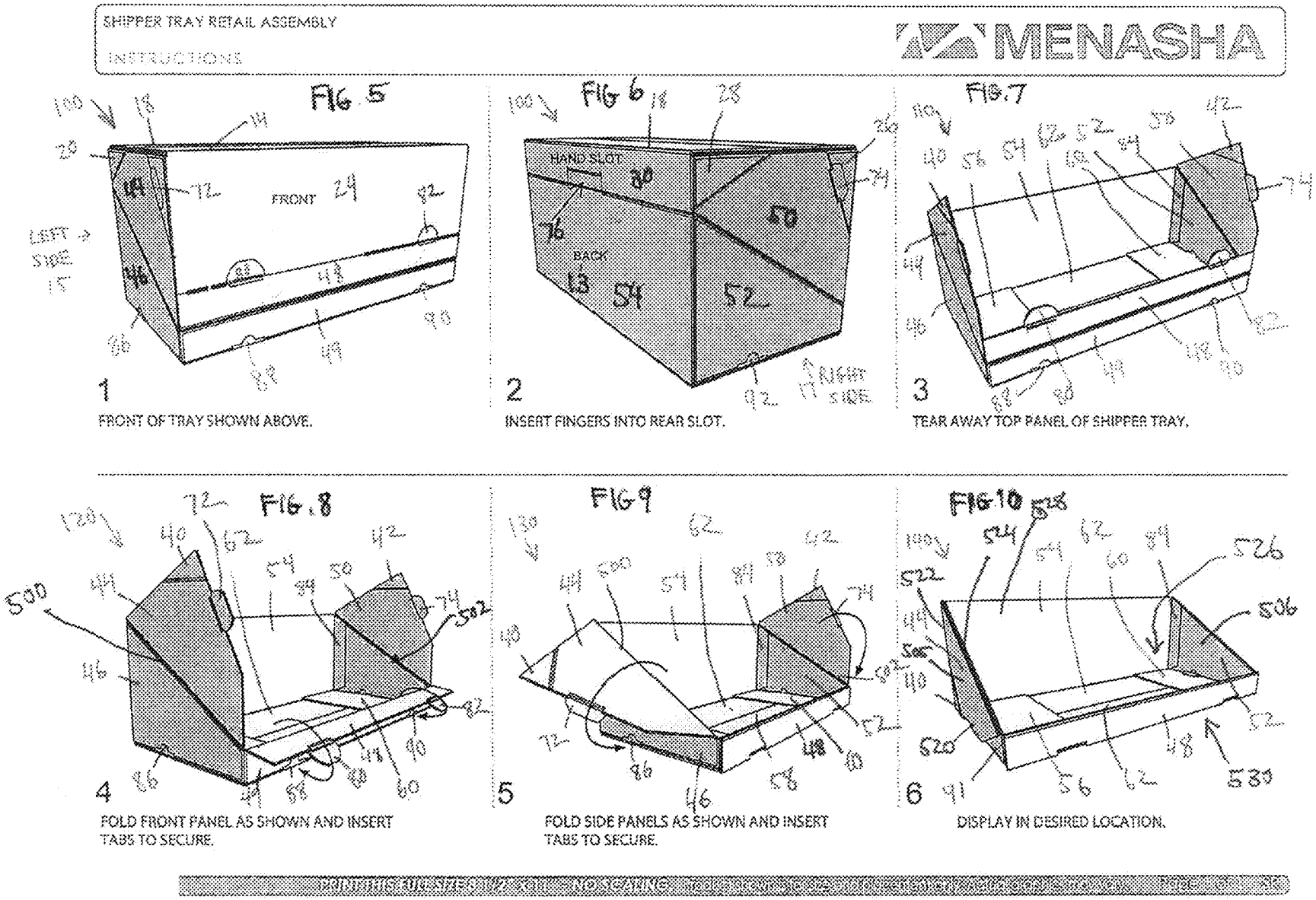
FIG. 5 is a perspective view of a front of a tear-away package.
FIG. 6 is a perspective view of a rear of a tear-away package.
FIG. 7 is perspective view of a tray blank prior to assembly and after removal of a tear-away portion of the tear-away package of FIGS. 5 and 6.
FIG. 8 is a perspective view of a step in assembling the tray.
FIG. 9 is a perspective view of a step in assembling the tray.
FIG. 10 is a perspective view of a tray fully assembled.

FIGS. 1, 2A,B show a blank 10 for forming a tear-away package 100 shown in FIGS. 5 and 6, and a tray shown in various degrees of assembly 110, 120, 130, 140 respectively in FIGS. 7-10 during an assembly or conversion process. One method for assembling the tear-away package 100 from the blank 10 is shown in FIG. 3, and for forming the tray blank from the tear-away package is shown in FIG. 4.

FIG. 1 shows the blank 10 having front panels 11, back panels 13, left side panels 15 and right side panels 17 of the tear-away package 100. The front panels 11 are divided by fold lines, extending in parallel spaced relationship, and specifically include a top major flap 14, a bottom major flap 58, and wall panels 24, 48 and 49. Similarly, the back panels 13 have a top major flap 18, a bottom major flap 62, and rear wall panels 18, 30, and 54 in parallel spaced relationship. The left side panels 15 have a top minor flap 12, a bottom minor flap 56, and left-side wall panels 20, 22, 44 and 46. Similarly, the right side panels 17 have a top minor flap 16, a bottom minor flap 60, and right-side wall panels 26, 28, 42, 50 and 52.

FIG. 2A shows the fold lines 200 for forming the tear-away package (FIGS. 5 and 6) from the blank 10. In one preferred aspect of the invention, the blank is formed from a single piece of corrugated paperboard material, a plastic sheet, a corrugated plastic sheet or other suitable material. FIG. 3 shows the tear-away steps of forming a package from the blank of FIG. 2A. The process steps of FIG. 3 do not necessarily have to be done in the exact order specified. The method steps will be referenced by adding 100 to the numbers referencing the fold lines. Thus, a step of folding across line 202 will be referred to as step 302, for example.

In steps 302 and 304, the left and right sides 15, 17 are formed by folding respectively along lines 202 and 204 ninety degrees (90°) into the plane of the paper. In step 306, the back 13 is formed by folding the back panels 13 90° along line 206 toward the right side 17 to form a rectangular sleeve. In step 308, tabs 78 and 84 are folded 90° along line 208 and are secured to an inner surface of panel 46 with glue or other attachment method or means.

In steps 318-324, the top and bottom minor flaps 12, 56, 18 and 62 are folded 90° inward of the container along lines 218, 220, 222, and 224 and the major flaps of the front and back 11,13 are folded along lines 210, 212, 214 and 216 90° inward of the rectangular sleeve and then over the minor flaps and secured with tape or adhesive to close the package. The rectangular sleeve could be of another polygonal shape in cross-section such as triangular, square, pentagonal, hexagonal, heptagonal, and octagonal, for example. The major and minor flaps cooperate to form a top wall and a bottom wall of the tear-away packages 100 shown in FIGS. 5 and 6. In this form, the tear-away package is in condition for shipping to a customer. The minor flaps 56 and 60 each have a portion removed to form a cutout 63 to make room in the bottom wall to receive tabs 80 and 82 when inserted into slots 88, 90 of the tear away package and the tray.

Figure 2B:
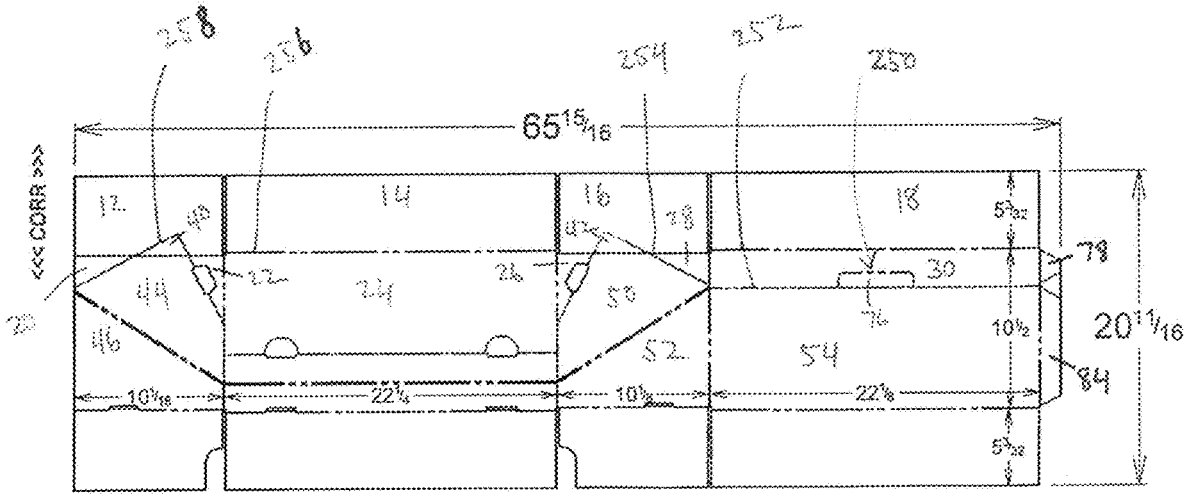
FIG. 2B shows tear lines for forming a tray.

FIG. 2B shows the tear lines for converting the tear-away packages 100, shown in FIGS. 5 and 6, into the tray blank 110 of FIG. 7. The method of converting is shown in FIG. 4 and the steps are referred to with reference numbers that add 200 to the tear line reference numbers of FIG. 2B. As shown in FIG. 4, in step 450, a handle 76 is pressed inward to break the frangible line 250, to provide a slot for a hand of a user to grab the panel 30, and in step 452 to pull along line 252 to remove panels 18, 30 and 78. In step 454, a user will continue to pull along frangible line 254 to remove panels 16, 26 and 28. In step 456 a user will continue to tear along line 256 to remove panels 14 and 24. The panels that are removed can be recycled or disposed of. Tear line 254 crosses into the top minor tab 16. In step 458 a user will tear along line 258 to remove panels 12, 20 and 22. Tear line 258 extends into the top minor flap 12. FIG. 7 shows the resulting tray blank 110.

FIG. 8 shows a step of folding panel 48 in the direction of the arrows, and tabs 80 and 82 are respectively inserted into slots 88 and 90 and are received within the cutouts 63. FIG. 9 shows the steps of folding left-side panels 44 and 40 along a diagonal fold-line 500 to place an outer surface of panels 44 and 40 into contact with an outer surface of panel 46. Panels 40 and 44 cooperate to form a generally right triangle shaped panel that is generally the mirror image of panel 46 across fold line 500, with the exception that a generally triangular shaped portion 91 (FIG. 10) of panel 46 is not covered by the panel 44. Tab 72 is inserted into slot 86 to secure the panels together in registration with one another leaving no rough edges from the fold over. Similarly, the right-side panel is formed by folding panels 42 and 50 along diagonal line 502 to place an outer surface of panels 42,50 into surface contact with an outer surface of panel 52. Panels 42 and 50 cooperate to form a generally right triangle shaped panel that is the mirror image of panel 52 across fold line 502 with the exception that a generally triangular shaped portion (not shown) of panel 52 is not covered. Tab 74 is inserted into slot 92 to secure the panels together in registration with one another leaving no rough edges from the fold over. The tabs 72 and 74 contact a top surface of minor panels 56 and 60 respectively. The panels that are secured can be removably secured or permanently secured.

FIG. 10 shows the completed tray 140 having double thickness right and left side panels and front panels 48,49, with the exception of portions 91 having a single layer thickness. The first and second generally triangular side panels 505, 506 each have a bottom leg 520, a vertical leg 522 and a hypotenuse leg 524. The second side panel 506 is spaced from the first side panel 505 and is in registration therewith to form a triangular-prism shaped body. A bottom panel 526 extends between the first side panel and the second side panel and connects the bottom legs 520 of each of the side panels. A generally polygonal shaped back wall 528 extends between the first side panel and the second side panel 505, 506 and connects the vertical legs 522 of each of the side panels. A front panel 530 extends between the first side panel and the second side panel and connects a front portion of each of the first side panel and the second side panel. A third generally triangular side panel depends from one of the legs of the first side panel, preferably the hypotenuse leg, and is secured to the first side panel in registration with the first side panel to form a double thickness wall. Similarly, a fourth generally triangular side panel depends from one of the legs, preferably the hypotenuse leg, of the second side panel and is secured to the second side panel in registration with the second side panel to form a double thickness wall.

Inner surface of panels 44, 48 and 50 can bear printed subject matter such as a product name, trademarks, instructions and the like typically found on product displays. By placing the printing on these panels 44,48,50, the printing will be protected from damage or scuffing during shipping as they are on an inside of the tear-away package. The back wall has a first height dimension and the front wall has a second height dimension less than the first height dimension.

A method for forming the display 140 includes the steps of providing a tear-away package having a top wall, a bottom wall, a back wall, a front wall, a right-side wall and a left-side wall. A frangible line extends continuously about the package from the right-side wall, the front wall, the left-side panel and the back wall. A user of the tear-away package tears the package along the frangible line to remove the top wall, a portion of each of the back wall, the front wall, the right-side wall and the left-side wall to define a tray blank 110 (FIG. 7) having a plurality of fold lines. The tray blank 110 has a back wall having a first height dimension and the front wall having a second height dimension less than the first height dimension. A user folds the tray blank along a diagonally extending fold line on the right-side panel to place a first triangular shaped panel over a second triangular shaped panel and in registration and secures the first triangular shaped panel to the second triangular shaped panel. A user also folds the tray blank along a diagonally extending fold line on the left-side panel to place a third triangular shaped panel over a fourth triangular shaped panel and in registration and secures the third triangular shaped panel to the fourth triangular shaped panel.

The method further includes the step of folding the tray blank along a fold line extending along the front wall to place a first front panel over a second front panel and in registration therewith and securing the first front panel to the second front panel.

Many modifications and variations of the present invention are possible in light of the above teachings. It is, therefore, to be understood within the scope of the appended claims the invention may be protected otherwise than as specifically described.

I claim:

1. A tear-away package comprising:

a front panel and a back panel, the front panel having a pair of slots spaced from one another;

a right-side panel and an opposed left-side panel connected to opposed ends of the front panel and the back panel to define a polygonal shaped sleeve;

a top panel and an opposed bottom panel attached to opposite ends of the polygonal shaped sleeve to form a sealed chamber the top panel is frangibly connected to the package to be torn away from a remaining portion of the package;

a first fold line extends diagonally across the right-side panel to define two subpanels;

a second fold line extends diagonally across the left-side panel to define two subpanels; and, a pair of minor flaps one of each minor flap extending from the right-side panel and the opposed left-side panel and cooperating to form a portion of the bottom panel, each minor flap having a portion removed to define a cutout positioned in registration with one slot of the pair of slots to define a tab receiving area.

2. The package of claim 1 wherein the top panel comprises two minor flaps and two major flaps.

3. The package of claim 2 wherein the bottom panel further comprises and two major flaps.

4. The package of claim 2 wherein one of the right side subpanels extends onto one of the minor flaps.

5. The package of claim 4 wherein one of the left side subpanels extends onto one of the minor flaps.

6. The package of claim 1 further comprising printed subject matter on an inner surface of one of the subpanels.

* * * * *